United States Patent [19]

Francke et al.

[11] Patent Number: 4,742,390

[45] Date of Patent: May 3, 1988

[54] ELEVATABLE OBSERVATION AND TARGET SYSTEM FOR COMBAT VEHICLES

[75] Inventors: Erwin Francke, Grobenzell; Heinrich Adler, Buchloe, both of Fed. Rep. of Germany

[73] Assignee: Krauss-Maffei Corporation, Fed. Rep. of Germany

[21] Appl. No.: 746,577

[22] Filed: Jun. 19, 1985

[30] Foreign Application Priority Data

Jun. 19, 1984 [DE] Fed. Rep. of Germany ..... 3422752

[51] Int. Cl.[4] ..... H04N 7/18

[52] U.S. Cl. ..... 358/108; 358/87; 358/229

[58] Field of Search ..... 358/109, 108, 93, 103, 358/125, 113, 87, 229, 105; 89/41.21, 41.19, 41.17, 41.05

[56] References Cited

U.S. PATENT DOCUMENTS

| | | | |
|---|---|---|---|
| 3,076,961 | 2/1963 | Bibbero | 358/109 |
| 3,641,261 | 2/1972 | Chaplin et al. | 358/109 |
| 3,689,695 | 9/1972 | Rosenfield et al. | 358/108 |
| 3,742,812 | 7/1973 | Woodworth et al. | 358/109 |
| 3,798,795 | 3/1974 | Michelson | 358/125 X |
| 3,854,115 | 12/1974 | Barthelemy | 367/93 |
| 4,012,989 | 3/1977 | Hunt et al. | 89/41.21 |
| 4,062,126 | 12/1977 | O'Hara et al. | 33/236 |
| 4,218,702 | 8/1980 | Brocard et al. | 358/109 |
| 4,386,848 | 6/1983 | Clendenin et al. | 358/108 X |
| 4,513,317 | 4/1985 | Ruoff, Jr. | 358/109 X |
| 4,518,990 | 5/1985 | Gilvydis | 358/87 |
| 4,570,530 | 2/1986 | Armstrong | 358/108 X |

FOREIGN PATENT DOCUMENTS

| | | |
|---|---|---|
| 977652 | 5/1961 | Fed. Rep. of Germany . |
| 2205826 | 2/1972 | Fed. Rep. of Germany . |
| 2357805 | 11/1973 | Fed. Rep. of Germany . |
| 2842684 | 9/1978 | Fed. Rep. of Germany . |
| 2841622 | 9/1978 | Fed. Rep. of Germany . |
| 2926972 | 7/1979 | Fed. Rep. of Germany . |

OTHER PUBLICATIONS

Search Report from West German Patent Application No. P 34 22 752.0.

Shilston, N. L., "Movement Detection for a Conditional Replenishment Codec", Digest No: 1984/59 from Electronics Div. Colloquium, May 17, 1984.

Huang, T. S., "Image Sequenc Analysis", Springer-Verlag, 1981.

Castleman, K. R., "Digital Image Processing", 1979.

Snyder et al., "Track Acquisition of Sub-Pixel Targets", *Image Sequence Processing*, NATO ASI Series, vol. F2, 1983.

Grossmann, J., "Zur Mustererkennung in Bildvorlagen Dynamischer Vorgange", Diss. Nr. 6489, 1979.

"Verarbeitung Optischer Grauwertmuster", AEG-Telefunken, 1983.

"FERI Flugkorper-Erfassungsgerat Infrarot", AEG-Telefunken.

*Primary Examiner*—Howard W. Britton
*Assistant Examiner*—Victor R. Kostak
*Attorney, Agent, or Firm*—Robert J. Koch

[57] ABSTRACT

An elevatable observation and target for combat vehicles increases safety and the reaction velocity by a stabilized vision line camera, that is remotely controlled from the combat compartment with an adjustable focal width prepared on an elevatable platform, with the camera comprising angle indicators for the generation of the prevailing sight line coordinates and the platform being capable of following the sight line of the panoramic camera as a function of the angle indicator signals.

12 Claims, 1 Drawing Sheet

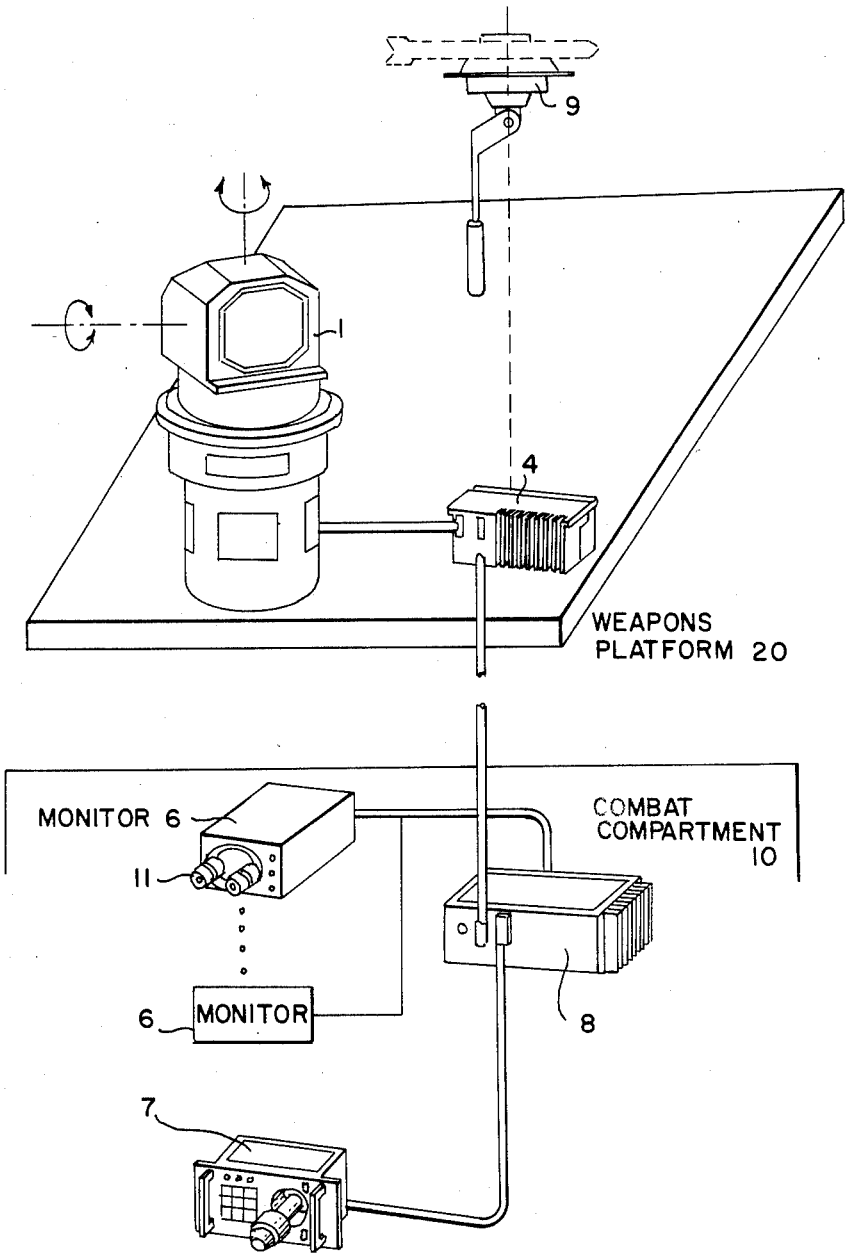
9
1
4
WEAPONS
PLATFORM 20
MONITOR 6
11
COMBAT
COMPARTMENT
10
6
MONITOR
8
7

ELEVATABLE OBSERVATION AND TARGET SYSTEM FOR COMBAT VEHICLES

BACKGROUND OF THE INVENTION

The invention relates to an observation and target system that can be raised for combat vehicles, consisting of a platform capable of being run out and/or pivoted in relation to the vehicle, on which at least one television camera is located, said camera being connected by means of a cable with at least one monitor provided in the combat compartment of the vehicle.

Observation and target systems of this type permit a substantial simplification of conventional observation platforms because the installations herertofore required for the housing and protection of the observer are eliminated.

SUMMARY OF THE INVENTION

The object of the present invention is to develop an elevatable observation and target system of the above-mentioned type to improve significantly near and long range field observation and thus make possible increased reaction velocity, and to simplify the entire weapons system and thus obtain a higher operating safety.

This object is attained because the television camera is an attitude stabilized panoramic camera, which can be remotely controlled in elevation and azimuth and has a focal range that is adjustable from the combat compartment. The camera is equipped with angle indicators to generate the prevailing line-of-sight coordinates. In particular, the platform supporting the panorama camera can pivot and is capable of following the azimuth.

The panoramic camera permits not only angular field of vision adjustments as a function of distance and sector observation, but it also makes possible a decisive increase in reaction time by means of functional coupling with the moving mechanism of the platform.

The panoramic camera with its zoom lens or its interchangeable objective lenses is preferably rigidly mounted on the platform and is equipped with a stabilized mirror head, that is adjustable in azimuth and elevation, with which the angle indicators for the generation of line-of-vision coordinates are correlated.

This configuration contributes to high operating safety and high adjusting velocities.

BRIEF DESCRIPTION OF THE DRAWING

The FIGURE shows a schematic of a system according to the invention.

DETAILED DESCRIPTION OF THE PREFERRED EMBODIMENT

The panoramic camera preferably comprises a high resolution television camera 1, the field-of-vision to resolution ratio of which approaches that of pure optical systems, and which in a particularly advantageous manner, may be combined with monitors 6 located in the combat compartment 10 in the form of small image flying spot tubes equipped with a binocular optical viewing device. Flying spot tubes of this type have screen diagonals of approximately 3 to 5 cm and in view of their low inertia masses are especially resistant to interference, even in rough operations. The binocular viewing device contributes to the increased concentration of the observer, provides an impression of direct viewing in a fully protected position, and contributes to the shortening of reaction times because of the possibility of rapid and accurate near and long range detection.

Appropriately, a thermal imaging device is integrated in the panorama camera and means are provided to display the images of the panorama camera and the thermal imaging device selectively on the monitors provided in the combat compartment. The observer or observers are thus able to select the optimum means of information based on the prevailing conditions, including a pivotable residual light amplifier, or to merge alternative information from the different image generators within the shortest possible period of time, thereby increasing the security of a decision to be made.

A further essential advantage of the invention is that electronic units 4, 8 to modify signals may be inserted in the signal path between the panorama camera and the monitor. Such signal modifications may comprise, for example, a variation of contrast, or a special optical target identification, by brightening or marking.

The insertion of an intermediate memory, which significantly facilitates or automates the detection of motion, is particularly advantageous. Image areas in which motion is to be detected may be programmed, preferably by position and magnitude, while image lines on which conditions are to be recognized may be programmed by the scanning of a scenical contour by a line of vision.

According to a further appropriate embodiment of the invention, it is possible with a slight electronic effort to combine information into the existing monitor image, particularly in the form of data and/or markings.

Items that may be combined for example, are the NATO cross-hairs, a measured distance and readiness for action. In a corresponding manner, data concerning the prevailing runout height and the firing direction of the platform, or the like, may also be blended in.

According to a further advantageous embodiment of the invention, the azimuthal movement may be effected by sectors, and the sector angle adapted to the angular coverage of the camera so that the sectors are always overlapping. During the change of sectors, the monitor being scanned is dark in keeping with a further characteristic of the invention, with the dark phase being chosen to be shorter than the ability of the human eye to react.

The platform 20 carrying the observation and target system is preferably in the form of a weapons platform, in particular for elevatably supported launchers. The platform is capable of following the targeting means in elevation.

Because the structural volume of the weapons platform is small in comparison with that of manned combat or observation platforms, this configuration is advantageous since in the retracted position a correspondingly smaller storage space is required for the housing of the weapons platform. Furthermore, it is advantageous that the system according to the invention is immediately ready for operation and may be used in any position between the retracted and fully extended state, both during the day and at night.

As the result of the sequence controls 7 provided according to the invention, the overall system is particularly user friendly and thus also safe in operation. This becomes apparent from the description of the process of attaching a target. For example: the gunner, observing the environment through the binocular viewing device 11 on the monitor 6, controls the primarily stabilized mirror head of the panorama camera 1 in azimuth and elevation by means of a gunner instrument 7. When the gunner discovers a target on his monitor 6, he is able to lock the weapons platform onto the target. In the process, the line-of-vision coordinates are transferred, whereupon the platform 20 may run in onto the line of vision of the panorama camera. The platform 20 follows the panoramic camera in the azimuth, while the launchers 9 provided on the platform follow in elevation. Once the gunner has identified the target, he may initiate the surveying of the target and the transfer of the target data to the fire control computer by actuating a target designation key. Once the platform and the launchers are run in on the target and the target is within the range of the launchers, the fire control computer clears the weapons for firing and the gunner is able to fire.

The use in the present invention of a high resolution panorama camera is of essential importance. The characteristics of such a camera given below represent a nonlimiting example used essentially to define the type of camera:

Number of lines: 1249
Objective lens: f=50 . . . 250 mm
Field of vision: 156 m at 4000 m, f=250 m
Angle of vision: 2.3°-11.5°
Directional range: azimuth n×360°
Directional range: elevation+20°, −10°.

The panoramic camera preferably is of a modular construction. In a first module the camera housing is combined with the pick-up tube and the video electronics; in a second module the objective housing with the objective lens and zoom adjusting mechanism; in a third module the stabilized, orientable mirror head with the angle indicators to transfer the location coordinates to the fire control computer; and a fourth module the stabilizing electronics and the signal processing unit.

The imaging capacity and the resolution of a camera used according to the invention make it possible with an objective lens having a focus of f=250 mm, to resolve objects with a dimension of 120 mm (120 mm=1 line) at a distance of 4000 m. As the identification of an object in the shape of an armored vehicle requires eight pairs of lines, objects larger than 1920 mm may be identified with a camera system described above as an example.

It is possible, however, to increase the imaging capacity in the target field by enlarging the zoom range to greater focal widths.

In summary, the most important advantages of the system according to the invention may be described as a significant simplification of the entire weapons system because the observer, who is located in the chassis and fully protected by armor, is able to observe and analyze near and target areas with a quality equivalent to direct observation and under unfavorable conditions, obtain even higher quality than direct observation by means of the binocular viewing device; that a high reaction velocity may be obtained by sector observation and distance dependent angle of vision settings, which may be further enhanced by the blending of data into the field of vision of the observer; and that the observer may be aided in the detection and tracking of targets by electronic image processing, which again has a positive effect on the reaction velocity.

We claim:

1. Combat vehicle observation and targeting system comprising:

a weapons platform;

means for elevating and pivoting said platform;

a line of sight stabilized scanning television camera located on said platform;

means for connecting said camera to a monitor arranged in a combat compartment of said vehicle;

means for remotely controlling elevation, azimuth, and focal width of said camera located in said combat compartment and connected to said camera;

angle indicator means for indicating prevailing vision line coordinates connected to said camera; and signal processing means connected to said camera for comparing stored visual information with current visual information to detect movements and display them by blending signals at relevant locations into an image displayed on said monitor with said camera means for azimuthally aligning said weapons platform.

2. System according to claim 1, wherein said camera is rigidly mounted on the platform and further comprises a zoom lens and interchangeable objective lenses;

and a stabilized mirror head adjustable in azimuth and elevation, wherein said angle indicator means is correlated with said mirror head.

3. System according to claim 1, wherein said camera is a high resolution (HDTV) camera and said monitor is a small screen flying spot tube with a binocular optical viewing device.

4. System according to claim 1, further comprising a thermal imaging device integrated in said camera and means for selectively displaying thermal images on said monitor associated with said monitor.

5. System according to claim 1, further comprising means for extending use of said camera to twilight and night, including a residual light amplifier pivotable into a position between an objective and the camera.

6. System according to claim 1, wherein said signal processing means comprises means for detecting and displaying magnitude and position of said movements.

7. System according to claim 1, further comprising means for scanning a scenic contour by a line of sight associated with said camera.

8. System according to claim 1 wherein said signal processing means further comprises means for displaying information in the form of data markings by blending said information into said monitor image.

9. System according to claim 1 further comprising a plurality of monitors, connected in parallel.

10. System according to claim 1, further comprising weapon launchers and means for aligning elevation of said launchers with said camera.

11. System according to claim 1 further comprising means for effecting azimuth movement at said camera by sectors and adjusting a sector angle to a pickup angle of the camera so that the sectors overlap in each case.

12. System according to claim 11, wherein said means for effecting azimuth movement further effects a dark monitor phase during a change of sectors, said dark phase is shorter than the reaction ability of the human eye.

* * * * *